United States Patent [19]

Stegens

[11] 4,281,302

[45] Jul. 28, 1981

[54] QUASI-ELLIPTIC FUNCTION MICROSTRIP INTERDIGITAL FILTER

[75] Inventor: Ronald E. Stegens, Brookeville, Md.

[73] Assignee: Communications Satellite Corporation, Washington, D.C.

[21] Appl. No.: 108,250

[22] Filed: Dec. 27, 1979

[51] Int. Cl.[3] ..... H01P 1/203; H01P 1/205; H01P 3/08

[52] U.S. Cl. ..... 333/204; 333/205; 333/246

[58] Field of Search ..... 333/202, 203, 204, 205, 333/245, 246, 219–223, 235; 334/41–45, 85; 330/286–287, 306, 170, 53

[56] References Cited

U.S. PATENT DOCUMENTS

| | | | |
|---|---|---|---|
| 3,327,255 | 6/1967 | Bolljahn et al. . | |
| 3,754,198 | 8/1973 | Anghel | 333/204 |
| 4,020,428 | 4/1977 | Friend et al. . | |

*Primary Examiner*—Marvin L. Nussbaum
*Attorney, Agent, or Firm*—Sughrue, Rothwell, Mion, Zinn and Macpeak

[57] ABSTRACT

The Frequency response of a Microstrip Interdigital Filter (MIDF) is improved by providing a specially dimensioned top cover separated from the MIDF ground plane along one or both of its edges by a dielectric layer comprised of thin dielectric sheets. While the upper frequency skirt is mainly determined by the MIDF itself, the bandwidth may be reduced and the slope of the lower frequency skirt may be enhanced by providing the cover in accordance with the invention. The thickness of the dielectric layer can be chosen to further improve the slope of the low frequency skirt by effectively moving the filter zero closer to the desired low frequency cut-off of the filter. The particular choice of the dielectric thickness will not substantially affect the filter bandwidth.

9 Claims, 9 Drawing Figures

FIG 1A
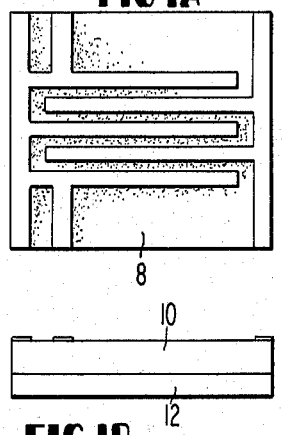
FIG 1B
FIG 1C
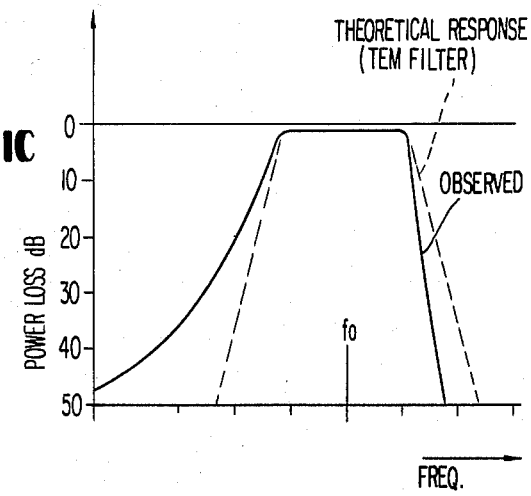
FIG 2A
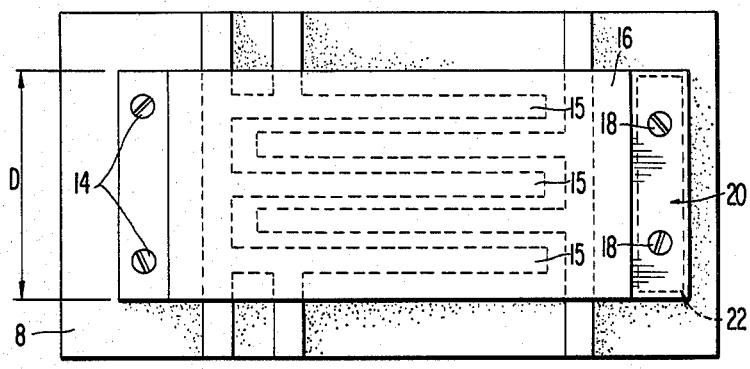
FIG 2B
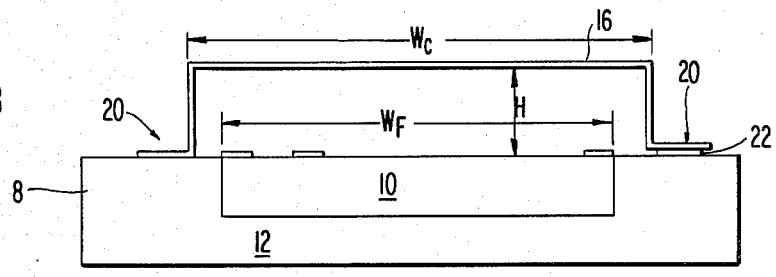
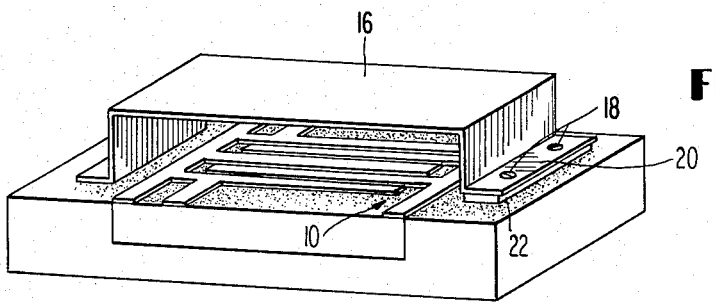
FIG 2C

QUASI-ELLIPTIC FUNCTION MICROSTRIP INTERDIGITAL FILTER

CROSS REFERENCE TO RELATED APPLICATION

This is an improvement of the invention disclosed in co-pending U.S. Pat. application Ser. No. 934,460 for a "Microstrip Interdigital Filter", the disclosure of which is hereby incorporated by reference.

BACKGROUND OF THE INVENTION

The Microstrip Interdigital Filter (MIDF) which utilizes non-TEM propagation of microwave energy as disclosed in co-pending U.S. Pat. application Ser. No. 934,460 has a frequency characteristic generally indicated in FIG. 1*c*. While the filter performs well at its upper frequency skirt, the rejection of undesired energy below the intended passband has been found to be insufficient in some applications since the frequency drop-off at the lower frequency skirt is more gradual than the drop-off at the upper skirt.

SUMMARY OF THE INVENTION

The above mentioned problem associated with the lower frequency skirt is alleviated by providing a specially dimensioned top cover separated from the ground plane of the MIDF along one or both of the edges of the top cover by a dielectric layer comprised of one or more thin dielectric sheets. The slope of the lower frequency skirt is determined by (1) the presence of the cover, (2) the number or thickness of dielectric sheets provided between the MIDF ground plane and the top cover, and (3) whether the dielectric sheet or sheets are placed between the MIDF ground plane and the top cover at one or both ends of the top cover. While the location of the upper frequency skirt is mainly determined by the MIDF itself, the bandwidth of the filter can be adjusted by (1) providing the cover and (2) adjusting the cover width to produce the desired bandwidth adjustment.

PRIOR ART

There exist in the prior art various attempts to effect a change in the characteristics of microstrip filters by providing a "cover" type structure in association with the filter. Friend et al. (U.S. Pat. No. 4,020,428) in FIG. 3 teaches the use of a removable ground plate cover 14 at a strip line interdigital bandpass filter to adjust the filter bandwidth. The bandwidth of the filter may be modified by changing the width "d" of the cover 14. This reference does not, however, teach a dielectric layer between the filter and the top cover to enhance the performance of the filter.

The patent to Anghel (U.S. Pat. No. 3,754,918) in FIG. 2 teaches the use of a cover 27 over a microstrip filter to vary the unloaded Q. Anghel, like Friend et al. does not teach the use of the above mentioned dielectric layer. Furthermore, only the Q of the filter is varied by Anghel.

A computer technique for calculating the characteristic impedance, phase velocity, and effective dielectric constant of single or coupled microstrip lines is discussed in "Computer Program Description", *IEEE Trans. on Microwave Theory and Techniques,* April 1971, pp. 418–419. Among the input parameters which may be specified by the user is the existence and distance above the microstrips of a second (covering) ground plane.

DESCRIPTION OF THE DRAWINGS

FIGS. 1*a* and 1*b* illustrate the microstrip interdigital filter as generally shown in co-pending application, Ser. No. 934,460. FIG. 1*c* illustrates the frequency response of the filter taught in co-pending application Ser. No. 934,460.

FIG. 2*a* is a top view of the microstrip interdigital filter in combination with the cover and shims of the present invention.

FIG. 2*b* is a front view of the microstrip interdigital filter in combination with the cover and shims of the present invention.

FIG. 2*c* is a perspective view of the MIDF and cover.

DETAILED DESCRIPTION OF THE INVENTION

FIGS. 1*a* and 1*b* illustrate the basic design of the microstrip interdigital filter (MIDF) as disclosed in the co-pending U.S. Pat. application Ser. No. 934,460. The MIDF 8 is comprised of a metal frame 12 having dielectric slab 10 such as $Al_2O_3$ deposited thereon. The edges of the dielectric slab are plated over or otherwise made conductive to complete the ground return for the resonators on the top side. The frequency response of the MIDF is shown in FIG. 1*c*. The upper frequency skirt exhibits an exceptionally sharp attenuation outside the passband of the filter as shown in the Figure. The lower frequency skirt of the filter, however, exhibits a relatively gradual drop-off in attenuation below the passband of the filter. The lower frequency skirt performance of the MIDF is inadequate for certain applications where a steep slope at the lower frequency skirt is required.

Figure 3:
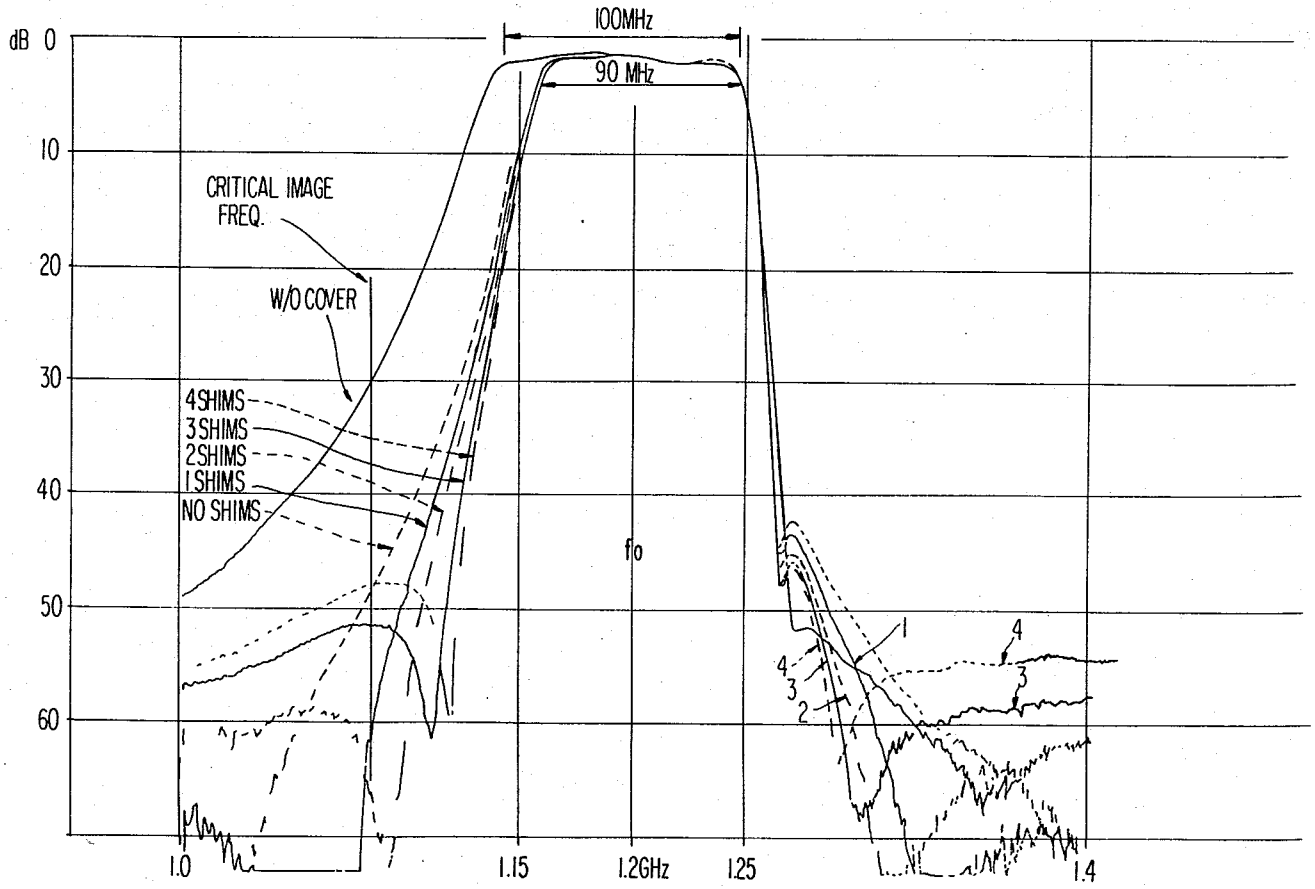
FIG. 3 illustrates the frequency response of the filter according to the present invention as a function of the thickness of the dielectric layer.
Figure 4:
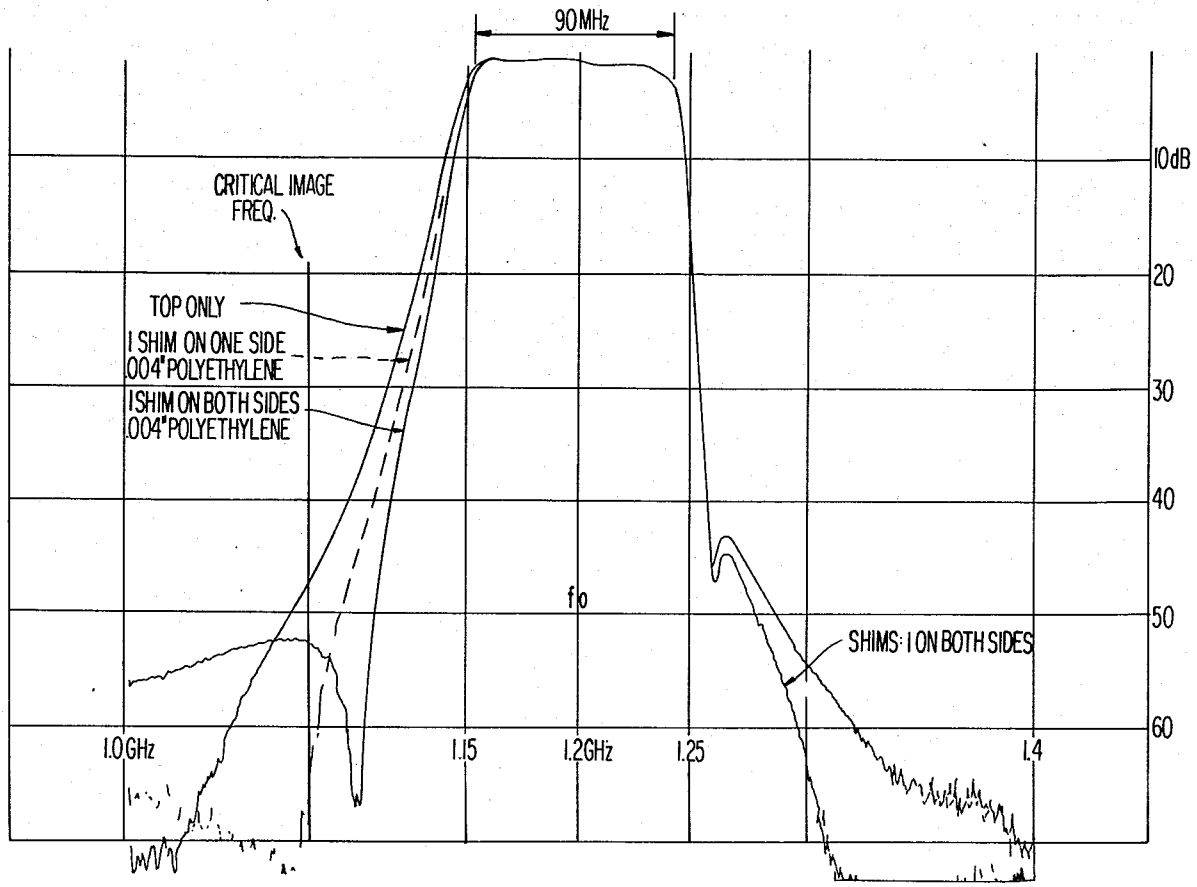
FIG. 4 illustrates the frequency response of the filter according to the present invention as a function of shim placement.
Figure 5:
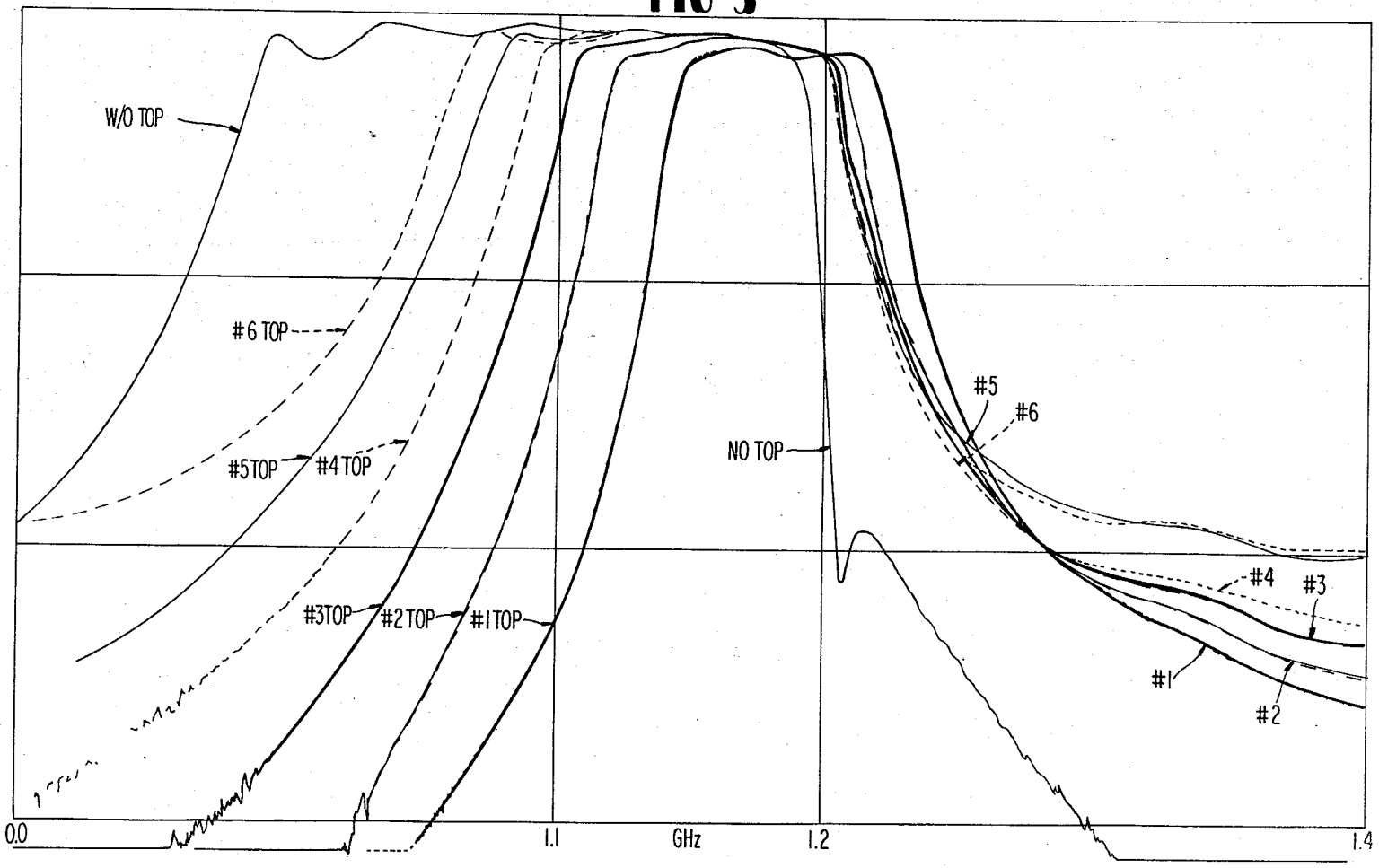
FIG. 5 illustrates the frequency response of an MIDF as a function of cover width.

This shortcoming can be overcome in accordance with the present invention shown in FIGS. 2*a*–2*c*. Filter 8 is provided with cover 16 attached to the metal frame 12 and which completely covers the parallel interdigital portions 15 of the filter. The cover 16 may be separated from the ground plane of the filter (metal frame 12) by one or more dielectric "shims" 22. The one or more shims 22 may be located between one or both of the cover flanges 20 and the metal frame 12. The cover 16 is secured to metal frame 12 by means of dielectric screws 18 which may be made of nylon and are provided at the flanges 20 having one or more dielectric shims located thereunder, or metal screws 14 which are provided for a flange which is mounted directly on metal frame 12. The shims used in accordance with the invention as characterized in FIGS. 3–5 are each 0.004" thick and are comprised of polyethylene. As seen from FIG. 2(*c*), the cover 16 is attached to the supporting structure at ends running parallel to the interdigital portions of the filter and is open in a direction perpendicular to the interdigital portions.

FIG. 3 illustrates the frequency characteristics of the MIDF in accordance with the teachings of the present invention. The MIDF frequency response without a cover is compared to the frequency response of the MIDF filter provided with a cover as illustrated in FIG. 2. The use of from 0 to 4 shims (each 0.004") on one side of the cover is shown in the Figure. Rather than vary the number of shims, the thickness of the dielectric can be varied to effect the same result, since it is the total separation of the cover and filter by the dielectric which is of importance.

It can be seen in this example that providing the cover not only increases the slope of the low frequency skirt, but also reduces the bandwidth of the filter from approximately 100 MHz to 90 MHz. Note further that the addition of the shims affects the slope of the low frequency skirt by moving the low frequency zero of the filter but does not substantially affect the filter bandwidth. The upper frequency cut-off is substantially determined by the MIDF, the addition of the cover and shims having little effect thereon.

FIG. 4 illustrates and compares the operational characteristics of the MIDF in accordance with the present invention for various placements of a single 0.004" polyethylene shim. The Figure illustrates the use of no shims, a shim on one side and a shim on both sides of the cover. The Figure shows that the addition of a shim on one side of the cover increases the slope of the low frequency skirt. Adding a shim to the other side of the cover produces a further increase in the slope of the low frequency skirt. The addition of shims to one or both sides of the cover, however, does not substantially affect the high frequency skirt or the filter bandwidth.

The measured frequency response curves in FIGS. 3 and 4 illustrate some typical results. The responses strongly resemble the frequency characteristics which one would expect from an elliptic function filter. Transmission zeros are present both above and below the passband allowing very large rejection values at frequencies quite close to the passband. In FIG. 4, it can be seen that the transmission zero produced by the apparatus in accordance with this invention can be located at a specific desired frequency where spuruious signals may be located.

The cover width $W_c$ of the MIDF employed in generating FIGS. 3 and 4 was approximately 50% greater than the width of the MIDF itself and is measured along a line parallel to the interdigital portions of the filter as shown in FIG. 2. The cover height H is determined in accordance with MIDF design criteria in a well-known manner as discussed in the *IEEE Trans.* article "Computer Program Description", referred to above. The depth D of the cover is not at all critical to the present invention and merely requires that the interdigital portion of the filter be covered.

Variations in filter bandwidth can be effected by making adjustments to the cover dimensions as illustrated in FIG. 5 which shows the variation of frequency response with the ratio of cover width $W_c$ to filter width $W_f$ listed ain the table below. The plots in FIG. 5 were produced using a $W_f$ of 1.003, but the same relative change in bandwidth will be obtained according to the ratio of $W_c$ to $W_f$, regardless of the absolute dimensions. The cover in this case is not provided with any dielectric shims. The upper frequency cut-off is mainly determined by the MIDF itself, while the low frequency cut-off is determined by the MIDF and the cover dimensions.

TABLE

| Top | $W_c/W_f$ |
|---|---|
| 1 | 1.02 |
| 2 | 1.22 |
| 3 | 1.42 |
| 4 | 1.67 |
| 5 | 2.01 |
| 6 | 2.41 |

An apparatus has thus been disclosed for producing a quasi-elliptic function microstrip interdigital filter from the MIDF disclosed in the co-pending U.S. Pat. application Ser. No. 934,460. The dimensions of the cover and shims are chosen so as to produce a transmission zero immediately below the desired passband. The number of shims determines the frequency at which the transmission zero will occur but does not substantially affect the bandwidth or frequency of the passband. Adjustment of the cover width may effect a change in the filter bandwidth.

Various changes, additions and omissions of elements may be made within the scope and spirit of the invention and it is to be understood that the invention is not limited to specific details, examples and preferred embodiments shown and described.

I claim:

1. In a microstrip interdigital filter having a desired passband, said passband comprising at least a lower frequency skirt, having a desired location and slope, said microstrip interdigital filter having a supporting structure and a microwave circuit mounted thereon; means for effecting a change in (1) said location of said low frequency skirt and (2) said slope of said low frequency skirt comprising:

(a) cover means having first and second ends fixedly attached to said supporting structure so as to cover said filter;

(b) a first dielectric layer located between said supporting structure and said first end of said cover means.

2. The filter of claim 1 wherein said location of said lower frequency skirt is substantially determined by the dimensions of said cover means, and said slope of said lower frequency skirt is substantially determined by the thickness of said dielectric layer.

3. The filter of claim 2 further comprising a second dielectric layer located between said supporting structure and said second end of said cover means, whereby said slope of said lower frequency skirt is further determined by the presence of said second dielectric layer.

4. The filter of claims 1, 2, or 3 wherein said microwave circuit includes a plurality of substantially parallel interdigital portions mounted on a dielectric substrate deposited on said supporting structure; wherein said cover means covers said interdigital portions and is (i) open in a direction substantially perpendicular to said parallel interdigital portions and (ii) affixed to said supporting structure at ends running parallel to said interdigital portions.

5. The filter of claim 4 wherein said cover means is electrically conductive.

6. The filter of claim 5 wherein said cover means is attached to said supporting structure at said first end by dielectric connector means, whereby said supporting structure is conductively isolated from said cover means at said first end.

7. The filter of claim 3 wherein said microwave circuit includes a plurality of substantially parallel interdigital portions mounted on a dielectric substrate deposited on a supporting structure; said cover means is electrically conductive, covers said interdigital portions and is (i) open in a direction substantially perpendicular to said parallel interdigital portions, and (ii) affixed to said supporting structure at said first and second ends by dielectric connector means, whereby said supporting structure is conductively isolated from said cover means, said first and second ends running parallel to said interdigital portions.

8. The filter of claim 6 wherein said first dielectric layer is comprised of polyethylene.

9. The filter of claim 7 wherein first and second dielectric layers are comprised of polyethylene.

* * * * *

UNITED STATES PATENT AND TRADEMARK OFFICE

CERTIFICATE OF CORRECTION

PATENT NO. : 4,281,302

DATED : July 28, 1981

INVENTOR(S) : Ronald Erwin Stegens

It is certified that error appears in the above—identified patent and that said Letters Patent is hereby corrected as shown below:

IN THE SPECIFICATION:

Col. 3, line 60, change "ain" to --in--.

Signed and Sealed this

*Thirteenth* Day of *October 1981*

[SEAL]

*Attest:*

GERALD J. MOSSINGHOFF

*Attesting Officer*

*Commissioner of Patents and Trademarks*